United States Patent [19]

Abe et al.

[11] 4,119,443

[45] Oct. 10, 1978

[54] METHOD FOR MANUFACTURING HARDENED MACHINED PARTS

[75] Inventors: Yoshihiko Abe; Isao Okabe, both of Tokyo; Atsushi Shirota, Kamagaya, all of Japan

[73] Assignee: Mitsubishi Seiko Kabushiki Kaisha, Tokyo, Japan

[21] Appl. No.: 781,469

[22] Filed: Mar. 25, 1977

[30] Foreign Application Priority Data

Apr. 6, 1977 [JP] Japan ..... 51/37807

[51] Int. Cl.[2] ..... C23F 7/00

[52] U.S. Cl. ..... 148/12.1; 148/15.5; 148/16.5; 148/16.6; 148/31.5; 148/39

[58] Field of Search ..... 148/12.1, 15.5, 16.5, 148/16.6, 31.5, 39; 75/126, 128

[56] References Cited

U.S. PATENT DOCUMENTS

| | | | |
|---|---|---|---|
| 1,723,015 | 8/1929 | DeFries | 148/31.5 |
| 2,083,208 | 6/1937 | Tofaute | 148/16.6 X |
| 2,188,137 | 1/1940 | Malcolm | 148/16.6 |
| 2,946,708 | 7/1960 | Berghaus et al. | 148/16.6 |
| 3,901,740 | 8/1975 | Anderson | 148/16.6 |

FOREIGN PATENT DOCUMENTS

| | | | |
|---|---|---|---|
| 1,950,004 | 4/1971 | Fed. Rep. of Germany | 75/126 C |
| 2,333,183 | 4/1974 | Fed. Rep. of Germany | 148/16.6 |
| 47-47,488 | 11/1972 | Japan | 75/126 C |

OTHER PUBLICATIONS

Molybdenum, Steels Irons Alloys, Archer 1948, Climax Molybdenum Co., N.Y. pp. 93–96.

Metals Handbook, 8th Ed., vol. 2, 1964, pp. 119–125.

*Primary Examiner*—Arthur J. Steiner

*Attorney, Agent, or Firm*—Larson, Taylor and Hinds

[57] ABSTRACT

Hardened machined parts are manufactured from rolled or forged steel which consists essentially of 0.05 to 0.15 wt % of C, up to 0.50 wt % of Si, up to 1.5 wt % of Mn, 0.30 to 1.0 wt % of Cr, 0.50 to 1.0 wt % of Mo, one or more of elements selected from the group consisting of 0.10 to 0.40 wt % of V, 0.03 to 0.20 wt % of Ti, 0.03 to 0.20 wt % of Nb and 0.0005 to 0.0050 wt % of B, the balance being Fe, in the following steps: cooling the steel in air from 900° C to 1,000° C; machining the cooled steel; and subjecting the machined steel to a nitriding treatment at 500° to 650° C for 2 to 8 hours.

3 Claims, No Drawings

METHOD FOR MANUFACTURING HARDENED MACHINED PARTS

BACKGROUND OF THE INVENTION

The present invention relates to a method for manufacturing hardened machined parts, and more particularly to a method for manufacturing nitrided machined parts from steel particularly for use under light load conditions.

It has been the usual practice that important steel parts which are manufactured by working steel material are subjected to a surface hardening treatment. In this case, when the surface hardening treatment is carried out by a nitriding process this process is superior to a carburizing process in that it gives higher hardness and does not cause severe strain on the parts during processing as is usual in a carburizing process. Therefore, it is very desirable that machine parts such as gears, cylinders, etc. which require absolute accuracy in dimension are subjected to a nitriding treatment since this can do away with the process necessary for correction of size after the nitriding treatment takes place. However, in conventional steel, when its core portion is given the required hardness prior to the nitriding treatment, its surface becomes so hard that machining is made impossible. On the other hand, when it is hardened to just a degree that allows easy machining, the hardness required for the machine part can not be obtained. In addition, conventional steel has a very poor nitriding ability so that it cannot make use of the advantageous characteristics of the nitriding treatment as above-mentioned.

In view of this, the inventors of the present application have previously proposed an invention entitled "Nitriding Steel of the Precipitation Hardening Type" as Japanese patent application Ser. No. 135293/1973. This steel is originally aimed at steel which has a core hardness above 350 Hv which had not been attainable in conventional nitriding steel until then. Accordingly, the hardness of this steel at the stage of being subjected to a solution heat treatment cannot be decreased below 280 Hv; in reality, therefore, such a high level of hardness making the effective machining of parts for use under low load conditions, e.g. parts for automobiles which are to be mass produced, impossible. That is, for example, when a usual gear which is commonly mass produced is taken into consideration, the gear cutting process is difficult unless the hardness of the gear blank is below 250 Hv. Consequently, as steel for such mass produced machine parts, one which has a hardness below 250 Hv at the stage of subjection to the solution heat treatment has to be aimed at. Of course, since this level of hardness is necessary for machining, the level of hardness after subsequent subjection to the nitriding treatment should be higher to give the strength to the machined part required of a machine part. A level of hardness of 280 to 300 Hv is satisfactory for parts produced in large quantity as above described, and a corresponding surface hardness above 650 Hv is sufficient.

SUMMARY OF THE INVENTION

It is an object of the present invention to provide a method for manufacturing nitrided machined parts for use under low load conditions which have a hardness making machining possible at the solution heat treated stage, and a relatively large depth of hardness after it is subjected to a nitriding process.

It is another object of the present invention to provide a method for manufacturing nitrided machined parts for use under low load conditions which have a hardness which allows their machining at the solution heat treated stage, and assures necessary toughness after being subjected to a nitriding treatment.

It is a further object of the present invention to provide a method for manufacturing nitrided machined parts for use under low load conditions which have a core hardness below 250 Hv at the solution heat treated stage and have a core hardness above 280 Hv as well as a surface hardness above 650 Hv after being subjected to a nitriding treatment.

According to the present invention, a method for manufacturing nitrided machined parts for use under low load conditions is provided in which after rolled or forged steel material consisting essentially of 0.05 to 0.15 weight % of C, up to 0.50 weight % of Si, up to 1.5 weight % of Mn, 0.30 to 1.0 weight % of Cr, 0.50 to 1.0 weight % of Mo, one or more elements selected from the group consisting of 0.01 to 0.40 weight % of V, 0.03 to 0.20 weight % of Ti, 0.03 to 0.20 weight % of Nb and 0.0005 to 0.0050 weight % of B, the balance being iron containing impurities inevitable in manufacturing steel, is machined at the solution heat treated stage, it is subsequently subjected to a nitriding treatment.

DESCRIPTION OF THE PREFERRED EMBODIMENTS

As previously explained, the present invention provides a method for manufacturing nitrided machined parts for use under low load conditions wherein after rolled or forged steel material consisting essentially of 0.05 to 0.15 weight % of C, up to 0.50 weight % of Si, up to 1.5 weight % of Mn, 0.30 to 1.0 weight % of Cr, 0.50 to 1.0 weight % of Mo, one or more elements selected from the group consisting of 0.10 to 0.40 weight % of V, 0.03 to 0.20 weight % of Ti, 0.03 to 0.20 % of Nb and 0.0005 to 0.0050 weight % of B, the balance being iron containing impurities inevitable in manufacturing steel, is machined at the solution heat treated stage, it is subsequently subjected to a nitriding treatment.

Now the reasons why the principal chemical components and their ranges for the rolled or forged steel which constitute the essential parts of the present invention were selected as described above will be briefly explained as follows:

Carbon

When the amount of carbon is less than 0.05 weight % the increase in hardness at the stage of nitriding is insufficient. Contrarily, when it is above 0.15 weight % it becomes difficult to suppress the hardness in the preliminarily treated state below 250 Hv.

Thus the range of carbon 0.05 to 1.5 weight % was decided on.

Silicon

Since when the content of silicon is high, it is necessary to raise the temperature etc. for the preliminary treatment, the amount of silicon has to be limited to 0.50 weight % which is necessary for melt-refining.

Manganese

As far as melt-refining is concerned, an amount below 1.0 weight % of manganese will be sufficient, but, in order to eliminate the mass effect at the time of the preliminary treatment, it is necessary to increase the amount as high as 1.5 weight %. However, if the amount exceeds this value, it is difficult to suppress the hardness in the preliminarily treated state below 250 Hv.

Thus manganese in the amount of up to 1.5 weight % was decided on.

Chromium

In order to assure a hardness above 650 Hv on the surface after nitriding, an amount above 0.30 weight % of chromium is necessary. Although, the more the amount is increased the higher the surface hardness becomes, when the content exceeds 1.0 weight %, it is difficult to maintain the hardness below 250 Hv at the time of preliminary treatment.

Thus chromium in an amount of 0.30 to 1.0 weight % was decided on.

Molybdenum

An amount above 0.50 weight % of molybdenum is necessary in order to effect an age hardening in cooperation with carbon contained in the amount as above described, but, even if the amount is increased above 1.0 weight % the degree of the age hardening does not increase as long as the content of carbon remains within the above range. Said increase in amount serves only to increase the hardness in the preliminarily treated condition.

Therefore the amount of molybdenum is to be restricted up to 1.0 weight %.

Vanadium

This element is effective to increase the degree of age hardening and the minimum amount to exhibit the effect is 0.10 weight %, but since the effect remains almost unchanged even if the amount exceeds 0.40 weight % the amount of vanadium has been determined as 0.10 to 0.40 weight %.

Boron

This element is effective to eliminate a mass effect at the time of the preliminary treatment and is necessary to be contained in cooperation with manganese as previously explained, its amount being above 0.0005 weight % in order to exhibit an effect on the hardenability of steel, but when the content exceeds 0.0050 weight % the toughness deteriorates.

Thus, 0.0005 to 0.0050 weight % has been decided as the range of boron.

Titanium and Niobium

When adding boron to steel it is necessary to previously add an amount above 0.030 weight % of Ti or Nb as a denitriding element at the time of melting, and an addition exceeding this value is effective to increase the degree of age hardening, but it also makes the preliminary treatment difficult.

Therefore, the content of titanium or niobium should be restricted to up to 0.20 weight %.

From the foregoing it will be appreciated that the chemical components of the steel which constitutes a principal component of the present invention are characterized in the following: the amounts of C and Mo which directly contribute to the precipitation hardening are decreased to the minimum as far as possible in order to decrease the hardness of the steel in the preliminarily treated state, and instead, such elements as V, Ti, Nb that promote the precipitation hardening and yet do not increase hardness in the preliminarily treated state, are combined so that the maximum degree of precipitation hardness can be expected. According to the present invention, after this steel has been subjected to a solution heat treatment at a temperature of 900° to 1,000° C, it is machined into machine parts followed by a carbonitriding process at a temperature of 500° to 650° C.

The following specific examples will serve to explain how the steel having chemical compositions as above described can eliminate manpower in manufacturing machine parts produced in large quantities and, particularly, for use under low load conditions, at which the present invention is aimed and which brings about economical advantages resulting from reduced manpower.

EXAMPLE 1

Three kinds of steel, "A", "B" and "C" according to the present invention, the chemical compositions of which are shown in Table I, and steel "SCM 3" according to the Japanese Industrial Standard as well as British nitriding steel "EN 40B", the chemical compositions of which are also shown in Table I, were respectively investigated as to their hardness at a preliminarily treated state, hardness of the core portion after subjection to a nitriding treatment, and their nitridability. The results are shown in Table II. As will be apparent from the table, it is possible for the steel utilized in the present invention to have a hardness below 250 Hv after a simple solution heat treatment that is carried out by cooling the steel in air, or cooling in air from a temperature of 900° C to 950° C after being hot forged. The hardness of the core portion after a subsequent gas carbonitriding process at a temperature of 650° for 6 hours or an ion carbonitriding process at a temperature of 600° C for 2 hours increases well above 285 Hv. Contrarily, in "JIS SCM 3" and "EN 40B", unless their hardness is previously increased above 290 Hv by subjecting them to succeeding normaliging, quenching and annealing processes after forging, their core hardness cannot be raised above 280 Hv after subjection to a nitriding process and this is apparently becoming a matter of great concern when machining them.

As to the ability of nitriding, in the steel utilized in the present invention, the surface hardness can be 650 Hv by a gas carbonitriding process at a temperature above 570° C for a 6 hours or by an ion carbonitriding process at a temperature of 600° C for 2 hours and the depth of hardness above 0.30 mm can be obtained which is absolutely necessary for achieving the objects of the present invention. Contrarily, in "JIS SCM 3" and "EN 40B", the nitriding treatment for a time period as above given by no means gives the depth of hardness of 0.30 mm and in "SCM 3" even the surface hardness of 650 Hv cannot be obtained.

EXAMPLE 2

Steel previously proposed by the inventors, e.g. Japanese patent application Ser. No. 135293/1973 as above described, the chemical compositions of which are also shown in the last column of Table I as kinds of steel as "NT" was investigated to ascertain its hardness in the preliminarily treated state and core hardness after being subjected to nitriding. The results are shown in Table III. As will be apparent from this, although the steel which has been subjected to a solution heat treatment gives a sufficient surface and core hardness when it is subjected to a nitriding process, the hardness at the preliminarily treated state is so high that the machine parts made of the steel on a mass producing scale cannot be easily machined. Therefore, in order to allow easy machining, the steel must be annealed, i.e. cooled in air from a temperature of 750° C, but since the steel has an excessively aged structure at the state of annealing it cannot exhibit the hardening phenomena by a subsequent nitriding treatment. Further it will be noticed that in any preliminarily treated state the steel cannot obtain a hardened layer of thickness of 0.3 mm by a gas carbonitriding process at a temperature of 570° C for 6 hours or an ion carbonitriding process at a temperature of 600° C for 2 hours.

From the forgoing, when it is intended that in place of machine parts to be manufactured in large quantities for use under low load conditions from case hardening steel of chrome-molybudenum base ("SCM 21", "SCM 22" according to the Japanese Industrial Standard) by the following process:

heat forging → normaliging (cooling in air from 900° C) → machining → carburizing (at 930° C for 2 hours) → quenching (cooling in oil from 850° C) → tempering (cooling in air from 175° C) → strain correction, the steel "NT" is to be utilized, the following process is required:

hot forging → annealing (cooling in air from 750° C) → machining → solution heat treatment (cooling in air from 950° C) → finish machining → nitriding (an ion carbonitriding at 600° C for 3 hours).

Thus it will be appreciated that when the steel "NT" is utilized in place of the case hardening steel of chrome-molybdenum base as widely used at present, in addition to the high price of the raw material itself, the machining process has to be carried out twice, in addition, the nitriding treatment which requires much longer than a carburizing treatment also becomes necessary, the use of the steel "NT" therefore is made economically higher than in the case where the conventional carburized parts were utilized.

Contrarily, when the machine parts to be manufactured in large quantities for use in a low load are made of the steels "A" to "C" according to the present invention as shown in Table I, judging from the data as shown in Table II they can be manufactured by the following processes:

hot forging → solution heat treatment (cooling in air from 900° to 950° C) → machining → nitriding (ion carbonitriding at 600° C for 2 hours).

Thus, it will be readily understandable that the machine parts can be manufactured through only four processes, thus decreasing the number of process compared with the case of the machine parts of the conventional case hardening steel. Further, since the time period for the nitriding process is two hours the same as in the carbonization, the economical advantages obtainable by the use of steel as utilized in the present invention becomes much higher than in the case where the steel "NT" as previously proposed by the present inventors is used.

Further, since the nitrided parts manufactured according to the present invention exhibit a hardness distribution as shown in Table II, they can be recognized as being satisfactory. Additionally, since the mechanical properties at their core portion have the following values, they can be used in place of the conventional carburized machine parts also from this respect:

| Tensile strength | Yield Point | Elongation |
|---|---|---|
| 92 kg/mm² | 80 kg/mm² | 20% |
| Reduction of Area | Charpy Impact Value | |
| 66% | 12 kg-m/cm² | |

Table I

| | | Chemical Composition (wt %) | | | | | | | | | | | |
|---|---|---|---|---|---|---|---|---|---|---|---|---|---|
| | | C | Si | Mn | P | S | Ni | Cr | Mo | V | B | Ti | Nb |
| Steel according to the Present Invention | A | 0.06 | 0.25 | 1.23 | 0.008 | 0.007 | 0.13 | 0.70 | 0.73 | 0.12 | — | — | 0.09 |
| | B | 0.12 | 0.15 | 1.03 | 0.012 | 0.008 | 0.09 | 0.57 | 0.80 | 0.32 | — | — | — |
| | C | 0.09 | 0.30 | 0.72 | 0.010 | 0.007 | 0.08 | 0.75 | 0.91 | 0.17 | 0.0024 | 0.04 | — |
| JIS SCM3 | | 0.35 | 0.31 | 0.75 | 0.009 | 0.008 | 0.10 | 1.03 | 0.22 | — | — | — | — |
| EN 40B | | 0.24 | 0.27 | 0.57 | 0.012 | 0.010 | 0.11 | 3.25 | 0.52 | — | — | — | — |
| NT | | 0.15 | 0.25 | 0.75 | 0.009 | 0.009 | 0.10 | 0.81 | 0.90 | 0.35 | — | — | — |

Table II

| | | Preliminary Treatment | | Gas Carbonitriding (570° C × 6hr) | | | Ion Carbonitriding (600° C × 2hr) | | |
|---|---|---|---|---|---|---|---|---|---|
| | | Process | Hardness (Hv) | Surface (Hv) | Depth of Hardened Layer(mm) | Core Hardness (Hv) | Surface Hardness (Hv) | Depth of Hardened Layer(Hv) | Core Hardness (Hv) |
| Steel according to the Present Invention | A | Cooling in air after forging | 240 | 740 | 0.35 | 285 | 730 | 0.37 | 288 |
| | | Cooling in air from 950° C after forging | 235 | 735 | 0.34 | 285 | 732 | 0.38 | 290 |
| | B | Cooling in air after forging | 245 | 670 | 0.33 | 290 | 675 | 0.32 | 295 |
| | | Cooling in air from 950° C after forging | 247 | 673 | 0.31 | 285 | 670 | 0.32 | 290 |
| | C | Cooling in air after forging | 245 | 750 | 0.31 | 295 | 752 | 0.30 | 298 |
| | | Cooling in air from 950° C after forging | 242 | 757 | 0.32 | 287 | 755 | 0.30 | 295 |
| JIS SCM3 | | Quenching and Annealing | 291 | 635 | 0.21 | 288 | 607 | 0.18 | 285 |
| EN 40B | | " | 295 | 890 | 0.20 | 295 | 855 | 0.18 | 295 |

Table III

| | Preliminary Treatment | | Gas Carbonitriding (570° C × 6hr) | | | Ion Carbonitriding (600° C × 2hr) | | |
|---|---|---|---|---|---|---|---|---|
| | Process | Hardness (Hv) | Surface Hardness (Hv) | Depth of Hardened Layer(mm) | Core Hardness (Hv) | Surface Hardness (Hv) | Depth of Hardened Layer(mm) | Core Hardness (Hv) |
| NT | Cooling in air from 750° C | 220 | 770 | 0.21 | 220 | 765 | 0.23 | 220 |
| | Cooling in air from 950° C | 290 | 805 | 0.23 | 360 | 785 | 0.25 | 355 |

What is claimed is:

1. A method for manufacturing nitrided machined parts from steel particularly for use under light load conditions consisting essentially of the steps of:hot rolling or forging steel which consists essentially of 0.05 to 0.15 weight % C, up to 0.50 weight % of Si, up to 1.5 weight % of Mn, 0.30 to 1.0 weight % of Cr, 0.50 to 1.0 weight % of Mo, one or more elements selected from the group consisting of 0.10 to 0.40 weight % of V, 0.03 to 0.20 weight % of Ti, 0.03 to 0.20 weight % of Nb and 0.0005 to 0.0050 weight % of B, the balance being Fe including impurities inevitable in making steel; subsequently, and without further annealing thereof, cooling the hot rolled or forged steel in air from a temperature of 900° to 1,000° C; machining the air cooled steel; and subjecting the machined steel to a nitriding process at a temperature of 500° to 650° C for from two to eight hours.

2. A method for manufacturing nitrided machined parts from steel particularly for use under light load conditions as claimed in claim 1 wherein said nitriding process is a gas carbonitriding process.

3. A method for manufacturing nitrided machined parts from steel particularly for use under light load conditions as claimed in claim 1 wherein said nitriding process is an ion carbonitriding process.

* * * * *